US007761035B2

(12) United States Patent
Tokarski et al.

(10) Patent No.: US 7,761,035 B2
(45) Date of Patent: Jul. 20, 2010

(54) PHOTOSENSITIVE BODY, IMAGE FORMING APPARATUS HAVING THE SAME AND ASSEMBLY METHOD OF PHOTOSENSITIVE BODY

(75) Inventors: Zbig Tokarski, Suwon-si (KR); Yong Jin Ahn, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/168,177

(22) Filed: Jul. 7, 2008

(65) Prior Publication Data

US 2009/0110438 A1 Apr. 30, 2009

(30) Foreign Application Priority Data

Oct. 31, 2007 (KR) ..... 10-2007-0109938

(51) Int. Cl.
*G03G 15/00* (2006.01)

(52) U.S. Cl. ..... 399/159; 399/90; 399/117

(58) Field of Classification Search ..... 399/90, 399/117, 159; 174/51
See application file for complete search history.

(56) References Cited

U.S. PATENT DOCUMENTS 6,185,390 B1 * 2/2001 Higeta et al. ..... 399/90
6,907,205 B2 * 6/2005 Himes et al. ..... 399/90
7,020,410 B2 * 3/2006 Zogg et al. ..... 399/90

FOREIGN PATENT DOCUMENTS

KR 2005-35548 4/2005

* cited by examiner

*Primary Examiner*—Judy Nguyen
*Assistant Examiner*—Barnabas T Fekete
(74) *Attorney, Agent, or Firm*—Stanzione & Kim LLP

(57) ABSTRACT

A photosensitive body to stably maintain an electric connection between a photosensitive drum and a shaft includes a photosensitive drum, a shaft serving as a rotational center of the photosensitive drum, and a grounding device to electrically connect the photosensitive drum and the shaft. The grounding device includes a shaft connecting portion electrically connected to the shaft, and an anchor portion fixedly stuck in an inner peripheral surface of the photosensitive drum. The anchor portion moves from a first state, in which the anchor portion is extended in a longitudinal direction of the photosensitive drum, to a second state, in which the anchor portion is extended in a radial direction of the photosensitive drum, and is fixed to the photosensitive drum.

20 Claims, 13 Drawing Sheets

PHOTOSENSITIVE BODY, IMAGE FORMING APPARATUS HAVING THE SAME AND ASSEMBLY METHOD OF PHOTOSENSITIVE BODY

CROSS-REFERENCE TO RELATED APPLICATIONS

This application claims priority under 35 U.S.C. §119(a) from Korean Patent Application No. 2007-0109938, filed on Oct. 31, 2007 in the Korean Intellectual Property Office, the disclosure of which is incorporated herein in its entirety by reference.

BACKGROUND OF THE INVENTION

1. Field of the Invention

The present general inventive concept relates to a photosensitive body, and more particularly, to a photosensitive body having a grounding device to electrically connect a photosensitive drum and a shaft, and to an image forming apparatus having the above photosensitive body.

2. Description of the Related Art

An image forming apparatus, such as a printer, a copying machine or a fax machine, prints an image on a printing medium according to an input image signal. Of the various types of image forming apparatuses, an electrophotographic image forming apparatus includes a photosensitive body having a photosensitive layer made of a photoconductive material.

An electrophotographic image forming apparatus is configured such that a photosensitive body is charged to a predetermined electric potential, light is scanned to the charged photosensitive body to form an electrostatic latent image on a surface of the photosensitive body, and a toner is supplied to the electrostatic latent image to develop the electrostatic latent image into a visible image. The visible image formed on the photosensitive body is transferred onto paper supplied from a paper feeding device. Thereafter, a residual electric potential on the surface of the photosensitive body is removed to initialize the surface of the photosensitive body, and then a development process of the next cycle is carried out.

In order to obtain an image of good quality through the development process, the photosensitive body is needed to be grounded by being electrically connected to a main body of the image forming apparatus.

The photosensitive body generally includes a photosensitive drum provided with a photosensitive layer on an outer peripheral surface thereof, a flange coupled to an end portion of the photosensitive drum, a shaft electrically connected to the main body of the image forming apparatus and rotatably supporting the flange, and a grounding device to electrically connect the photosensitive drum and the shaft.

Korean Patent Registration No. 0574052 (Publication No. 1020050035548) discloses a grounding member which includes a plate-shaped body having a shaft hole, through which a shaft passes, a first grounding piece provided near the shaft hole and contacted with an outer surface of the shaft, and a second grounding piece extending from an outer periphery of the plate-shaped body and contacted with an inner surface of a photosensitive drum.

In the above-mentioned grounding member, when the shaft passes through the shaft hole, the first grounding piece is deformed by the shaft, and is elastically contacted with the outer surface of the shaft. Also, when the flange is coupled to the photosensitive drum, an end portion of the second grounding piece is bent by the photosensitive drum, and is elastically contacted with the inner peripheral surface of the photosensitive drum.

However, in the above grounding device, because the second grounding piece is contacted with the inner peripheral surface of the photosensitive drum only by an elastic force of the second grounding piece, the second grounding piece cannot be in secure contact with the photosensitive drum, and thus there is a limitation in stably maintaining an electric connection state. Especially, in a case where the photosensitive drum is made of aluminum, an oxide film is formed on the inner peripheral surface of the photosensitive drum. Thus, if the contacting force of the grounding device to the photosensitive drum is not large enough to destroy the oxide film, the grounding state cannot be stably maintained.

Also, the conventional grounding device has a problem such that when the photosensitive body rotates, the first grounding piece is worn out by friction with the shaft, which causes deterioration of a connection between the grounding device and the shaft.

SUMMARY OF THE INVENTION

The present general inventive concept provides a photosensitive body to stably maintain an electric connection between a photosensitive drum and a shaft.

The present general inventive concept also provides an image forming apparatus having the above photosensitive body.

The present general inventive concept also provides an assembling method of the above photosensitive body.

Additional aspects and/or utilities of the general inventive concept will be set forth in part in the description which follows and, in part, will be obvious from the description, or may be learned by practice of the general inventive concept.

The foregoing and/or other aspects and utilities of the general inventive concept may be achieved by providing a photosensitive body usable with an image forming apparatus, the photosensitive body including a photosensitive drum, a shaft serving as a rotational center of the photosensitive drum, and a grounding device to electrically connect the photosensitive drum and the shaft, the grounding device including a shaft connecting portion electrically connected to the shaft, and an anchor portion fixedly stuck in an inner peripheral surface of the photosensitive drum.

The anchor portion may move from a first state, in which the anchor portion is extended in a longitudinal direction of the photosensitive drum, to a second state, in which the anchor portion is extended in a radial direction of the photosensitive drum, and may be fixed to the photosensitive drum.

The grounding device may further include a sleeve fitted around the shaft. The anchor portion may be extended from an end of the sleeve, and may move from the first state to the second state by a junction portion with the sleeve being bent by a force applied in an axial direction of the shaft.

The grounding device may further include a first sleeve and a second sleeve fitted around the shaft. The anchor portion may be provided between the first sleeve and the second sleeve, and may move from the first state to the second state by a middle portion thereof being bent by a force applied in an axial direction of the shaft.

The shaft may be provided with an expanding portion to press the anchor portion kept in the first state in the axial direction of the shaft to spread the anchor portion in the radial direction of the photosensitive drum.

The anchor portion may be provided with a pointed portion to be stuck in an inner peripheral surface of the photosensitive drum.

The grounding device may further include a conductive bearing portion to support the shaft.

The photosensitive body may further include a flange coupled to an end portion of the photosensitive drum. The grounding device may be fixed to the flange.

The flange may be provided with a conductive bearing to support the shaft, and the grounding device may be coupled to the conductive bearing.

The foregoing and/or other aspects and utilities of the general inventive concept may also be achieved by providing an image forming apparatus including a main body, a shaft electrically connected to the main body, a photosensitive drum rotating on the shaft, a flange coupled to an end portion of the photosensitive drum, and a grounding device to electrically connect the shaft and the photosensitive drum, the grounding device including a first sleeve fitted around the shaft, and a plurality of anchor portions extending from a first end of the first sleeve in an axial direction of the shaft. The plurality of anchor portions are spread out in a radial direction of the photosensitive drum by an expanding tool pressing the plurality of anchor portions in the axial direction, and are fixed to an inner peripheral surface of the photosensitive drum.

The plurality of anchor portions may be provided with pointed portions to be stuck in the inner peripheral surface of the photosensitive drum.

The plurality of anchor portions may be spread out in the radial direction of the photosensitive drum by junction portions with the first sleeve being bent.

The grounding device may further include a second sleeve provided opposite to the first sleeve while interposing the plurality of anchor portions therebetween. The plurality of anchor portions may be spread out in the radial direction of the photosensitive drum by middle portions thereof and junction portions with the first sleeve and the second sleeve being bent.

The expanding tool may be integrally formed at the shaft.

The grounding device may further include a shaft contacting portion connected to a second end of the first sleeve, which is elastically contacted with an outer peripheral surface of the shaft.

The grounding device may further include a shaft contacting portion connected to the first sleeve, which is provided with a bearing portion to support the shaft.

The first sleeve may be fixed to the flange.

The flange may be provided with a conductive bearing contacted with an outer peripheral surface of the shaft, and the first sleeve may be fixed in contact with the bearing.

The foregoing and/or other aspects and utilities of the general inventive concept may also be achieved by providing an assembling method of a photosensitive body, the method including fixing a grounding device having an anchor portion extending in a longitudinal direction of a photosensitive drum to a flange, coupling the flange to an end portion of the photosensitive drum to form a photosensitive drum assembly, and pressing the anchor portion in the longitudinal direction of the photosensitive drum to be spread out in a radial direction of the photosensitive drum and fixed to an inner peripheral surface of the photosensitive drum.

The method may further include coupling a shaft to the photosensitive drum assembly. When the shaft is coupled to the photosensitive drum assembly, the anchor portion may be pressed by the shaft and spread out in the radial direction of the photosensitive drum.

The foregoing and/or other aspects and utilities of the general inventive concept may also be achieved by providing a photosensitive body usable with an image forming apparatus, the photosensitive body including a photosensitive drum having a shaft and an inner peripheral surface, and a grounding device having a sleeve to receive the shaft of the photosensitive drum and one or more anchor portions extending outward from the sleeve to electrically connect to an inner peripheral surface of the photosensitive drum.

The one or more anchor portions may include a pointed end to pierce an insulation layer of the inner periphery surface of the photosensitive drum and establish an electrical connection with the photosensitive drum.

The foregoing and/or other aspects and utilities of the general inventive concept may also be achieved by providing a photosensitive body usable with an image forming apparatus, the photosensitive body including a photosensitive drum including a shaft having an expanded portion integrally formed thereon, and a grounding device having a sleeve to receive the shaft of the photosensitive drum and one or more anchor portions extending outward from the sleeve to engage the expanded portion of the photosensitive drum, wherein the one or more anchor portions expand as a result of engaging the expanding portion and form an electrical connection with the photosensitive drum.

The foregoing and/or other aspects and utilities of the general inventive concept may also be achieved by providing a photosensitive body usable with an image forming apparatus, the photosensitive body including a photosensitive drum including a shaft, and a grounding device having a plurality of sleeves to receive the shaft of the photosensitive body and a plurality of anchor portions disposed between the plurality of sleeves, wherein the anchor portions have a first end connected to one of the sleeves, a second end connected to an other of the sleeves, and a bending portion disposed between the first end and the second end to deform when the grounding device is pressed by the shaft.

The foregoing and/or other aspects and utilities of the general inventive concept may also be achieved by providing a photosensitive body usable with an image forming apparatus, the photosensitive body including a photosensitive drum having a shaft, and a grounding device including a shaft connecting portion having a conductive bearing portions rotatably mounted to receive the shaft of the photosensitive drum, and one or more grounding pieces to electrically connect to the photosensitive drum.

The foregoing and/or other aspects and utilities of the general inventive concept may also be achieved by providing a photosensitive body usable with an image forming apparatus, the photosensitive body including a photosensitive drum having a shaft, a flange including a conductive bearing having a shaft hole to receive the shaft of the photosensitive body, and a grounding device including a sleeve to electrical connect to the conductive bearing of the flange.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
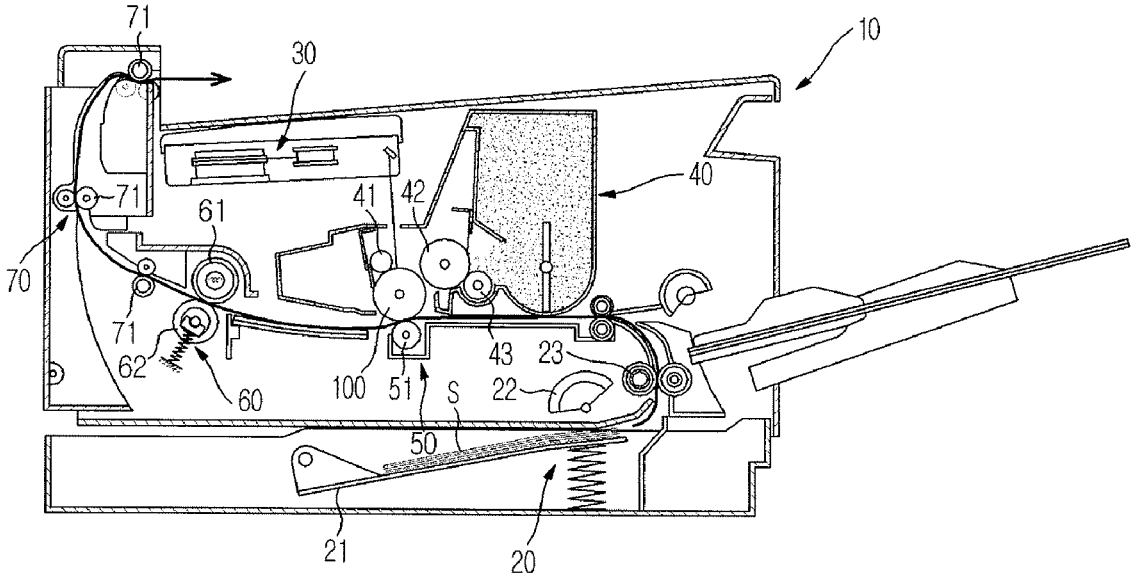
FIG. 1 is a sectional view illustrating a constitution of an image forming apparatus according to an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating a constitution of an image forming apparatus according to an embodiment of the present general inventive concept. As illustrated in FIG. 1, an image forming apparatus according to the present embodiment includes a main body 10 which forms an exterior appearance and supports components accommodated therein. Inside the main body 10 are mounted a paper feeding device 20, a laser scanning device 30, a developing device 40, a transfer device 50, a fusing device 60 and a paper discharge device 70.

The paper feeding device 20 supplies a printing medium, e.g., paper S, toward the developing device 40. The paper feeding device 20 includes a paper feeding tray 21 to load the paper S thereon, a pickup roller 22 to pick up the paper S loaded on the paper feeding tray 21 sheet by sheet, and a conveying roller 23 to convey the paper picked up by the pickup roller 22 toward the developing device 40.

The developing device 40 includes a photosensitive body 100, a charge roller 41, a development roller 42 and a supply roller 43. The charge roller 41 charges a surface of the photosensitive body 100 to a predetermined electric potential. When the laser scanning device 30 scans light corresponding to image information to the surface of the photosensitive body 100 charged to a predetermined electric potential, an electrostatic latent image is formed on the surface of the photosensitive body 100. The supply roller 43 supplies a toner contained in the developing device 40 to the development roller 42. The development roller 42 supplies the toner to the surface of the photosensitive body 100, on which the electrostatic latent image has been formed, to develop the electrostatic latent image into a visible image.

The transfer device 50 serves to transfer the visible image formed on the photosensitive body 100 onto the paper S. The transfer device 50 includes a transfer roller 51 mounted in the main body 10 while opposing the photosensitive body 100. The transfer roller 51 presses the paper S to the photosensitive body 100 so that a visible image formed on the surface of the photosensitive body 100 is transferred onto the paper S.

The fusing device 60 serves to fuse to the paper S the image, which has been transferred onto the paper S. The fusing device 60 includes a heating roller 61, in which a heat source is mounted, and a press roller 62 which is pressed to the heating roller 61 with a predetermined pressure. While the paper S passes between the heating roller 61 and the press roller 62, the image is fused to the paper S by heat transferred from the heating roller 61 and pressure generated between the heating roller 61 and the press roller 62.

The paper discharge device 70 includes a series of discharge rollers 71, to discharge the paper S having passed through the fusing device 60 to the outside of the main body 10.

Figure 2:
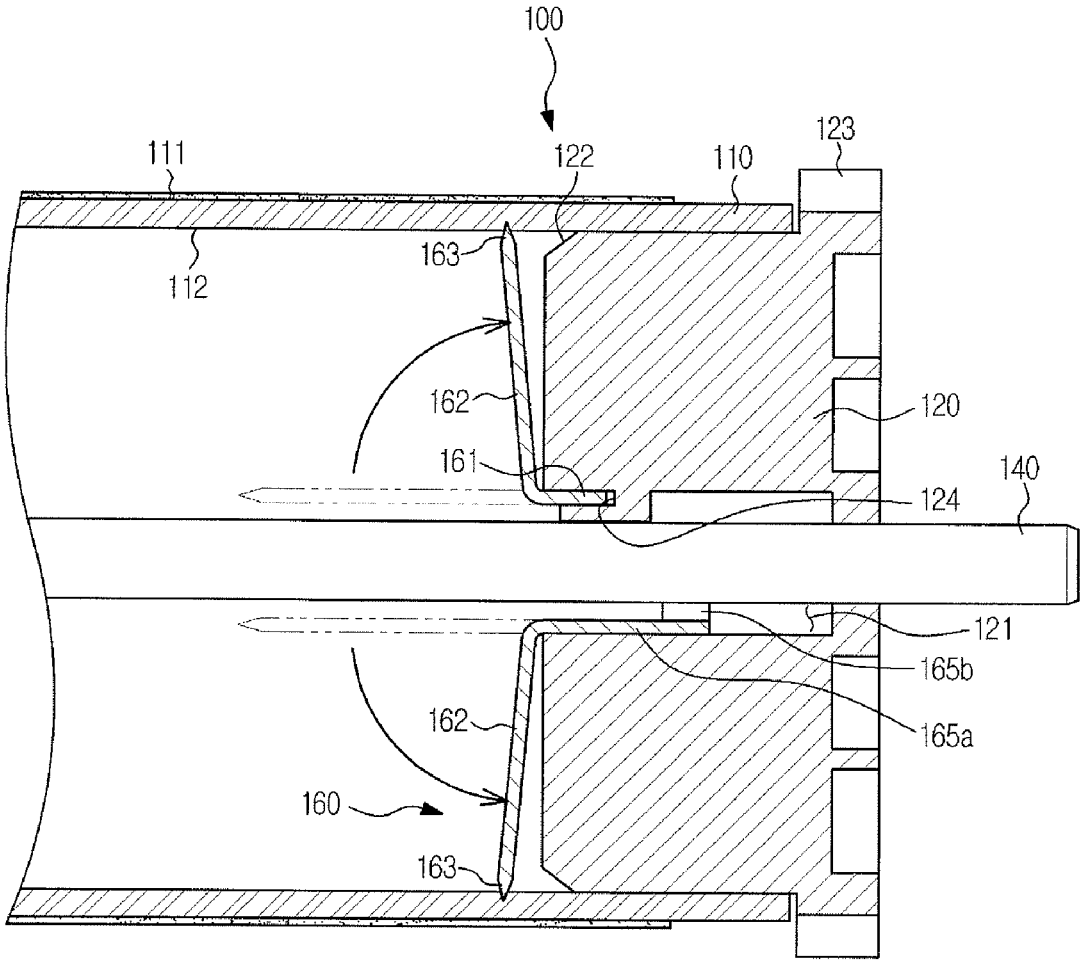
FIG. 2 is a sectional view illustrating a constitution of a photosensitive body according to an embodiment of the image forming apparatus according to the present general inventive concept.
Figure 3:
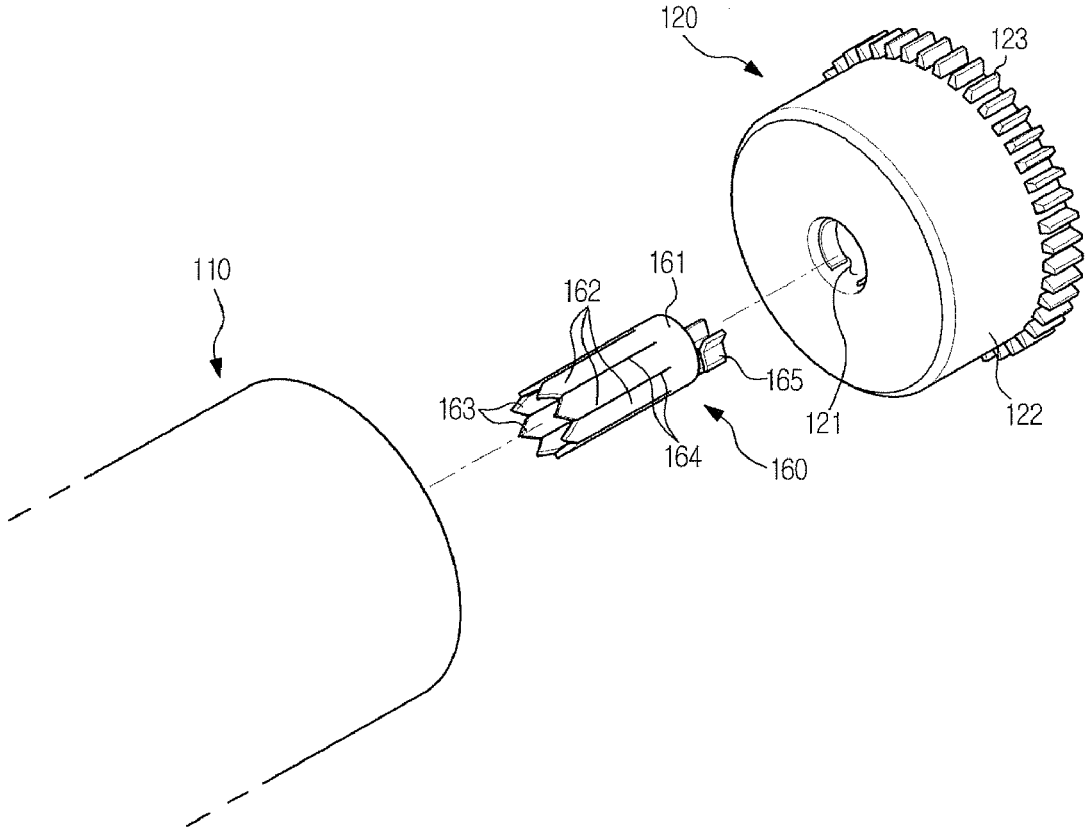
FIG. 3 is an exploded perspective view illustrating a photosensitive drum, a flange and a grounding device in the photosensitive body depicted in FIG. 2.

FIG. 2 is a sectional view illustrating a constitution of the photosensitive body according to an embodiment in the image forming apparatus according to the present general inventive concept, and FIG. 3 is an exploded perspective view illustrating a photosensitive drum, a flange and a grounding device in the photosensitive body depicted in FIG. 2.

As illustrated in FIGS. 2 and 3, the photosensitive body 100 includes a photosensitive drum 110 provided with a photosensitive layer 111 on an outer peripheral surface thereof, a flange 120 coupled to an end portion of the photosensitive drum 110, and a shaft 140 serving as a rotational center of the photosensitive drum 110.

The photosensitive drum 110 is formed in a cylindrical shape having both ends which are opened. The photosensitive drum 110 can be made of an aluminum material, which has conductivity, low weight and high strength. An image is formed on the photosensitive layer 111 of the photosensitive drum 110 through charging, light exposing, developing and static charge eliminating processes being performed repeatedly. In order to achieve the developing process, the photosensitive drum 110 is necessarily grounded. To this end, the photosensitive body 100 is provided with a grounding device 160 to electrically connect the photosensitive drum 110 and the shaft 140.

The flange 120 is made of a plastic material. The flange 120 includes a shaft hole 121, through which the shaft 140 passes, and a photosensitive drum coupling portion 122 which is forcedly inserted into an end portion of the photosensitive drum 110. A photosensitive body gear 123 is provided on an outer surface of the photosensitive drum coupling portion 122 so that the flange 120 can receive a driving force from the main body 10 of the image forming apparatus. When the photosensitive body 100 receives a rotational force through the photosensitive body gear 123, the photosensitive body 100 rotates on the shaft 140.

The shaft 140 supports the flange 120 so that the flange 120 can rotate. One end portion of the shaft 140 extends outwardly from the flange 120, through the shaft hole 121 of the flange 120. The shaft 140 is made of a conductive material. The end portion of the shaft 140 extending outwardly from the flange 120 is electrically connected to a terminal (not illustrated) provided in the main body 10.

The grounding device 160 is made of a conductive material (e.g., copper). The grounding device 160 includes a sleeve 161, through which the shaft 140 passes, a shaft connecting portion electrically connected with the shaft 140, and a photosensitive drum connecting portion electrically connected with the photosensitive drum 110.

As illustrated in FIGS. 2 and 3, the photosensitive drum connecting portion may be configured as a plurality of anchor portions 162 extending from a first end of the sleeve 161. Front ends of the anchor portions 162 are fixedly stuck in an inner peripheral surface 112 of the photosensitive drum. The front end of each of the anchor portions 162 may be provided with a pointed portion 163 so as to be easily stuck in the photosensitive drum 110.

By the plurality of anchor portions 162 being stuck in the inner peripheral surface 112 of the photosensitive drum, the grounding device 160 can be securely fixed to the photosensitive drum 110. In addition, since the plurality of anchor portions 162 are contacted with the photosensitive drum 110 by piercing through an insulation layer formed on the inner peripheral surface 112 of the photosensitive drum, the electric connection between the photosensitive drum 110 and the grounding device 160 can be maintained more stably.

As illustrated in FIG. 3, the plurality of anchor portions 162 are arranged along the periphery of the sleeve 161, and are separated from each other by cutting lines 164. Such a plurality of anchor portions 162, as illustrated in FIG. 2, move from a first state (refer to an imaginary line), in which the anchor portions 162 are extended in a longitudinal direction of the photosensitive drum 110, to a second state, in which the anchor portions 162 are extended in a radial direction of the photosensitive drum 110. When the anchor portions 162 are in the second state, the anchor portions 162 are fixed to the inner peripheral surface 112 of the photosensitive drum. A detailed explanation of a method to fix the anchor portions 162 to the photosensitive drum 110 will be made later.

Figure 4:
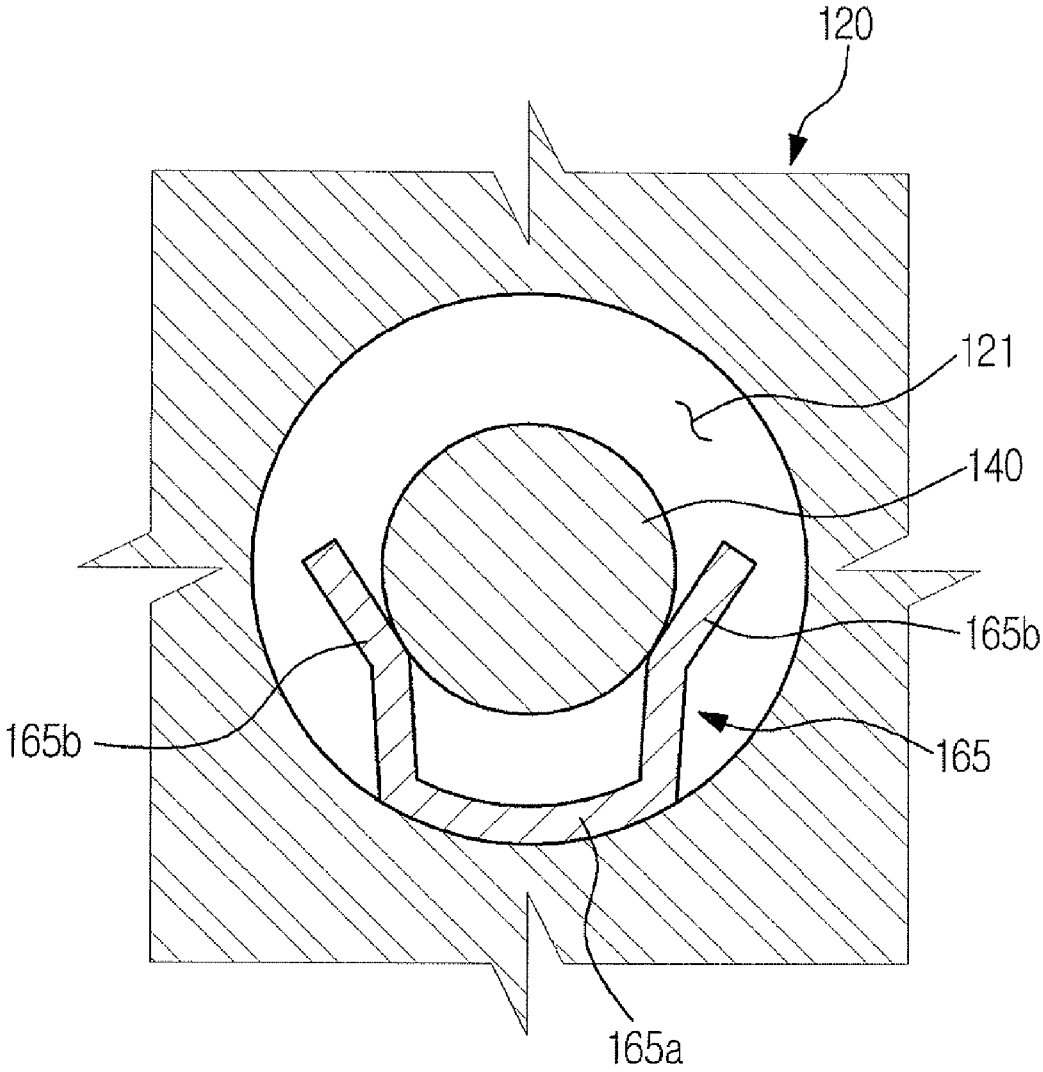
FIG. 4 is a sectional view illustrating a coupling relation between a shaft contacting portion and a shaft in the photosensitive body depicted in FIG. 2.

The shaft connecting portion of the grounding device 160 may be configured as a shaft contacting portion 165, which is directly contacted with an outer peripheral surface of the shaft 140. FIG. 4 is a sectional view illustrating a coupling relation between the shaft contacting portion and the shaft in the photosensitive body depicted in FIG. 2.

As illustrated in FIGS. 2 to 4, the shaft contacting portion 165 includes an extending portion 165*a* which extends from a second end of the sleeve 161, and two grounding pieces 165*b* which are unitarily formed with the extending portion 165*a*. The two grounding pieces 165*b* are arranged opposite to each other so as to interpose the shaft 140 therebetween. When the shaft 140 is fitted between the two grounding pieces 165*b*, the grounding pieces 165*b* are deformed by being pushed by the shaft 140, and are elastically contacted with the outer peripheral surface of the shaft 140.

As illustrated in FIG. 2, the shaft hole 121 of the flange 120 is provided with a fixing recess 124 to fix the grounding device 160. The grounding device 160 is fixed to the flange 120 in such a manner that the sleeve 161 of the grounding device 160 is inserted into the shaft hole 121 of the flange 120 and a portion of the sleeve 161 is forcedly inserted into the fixing recess 124.

Figure 5:
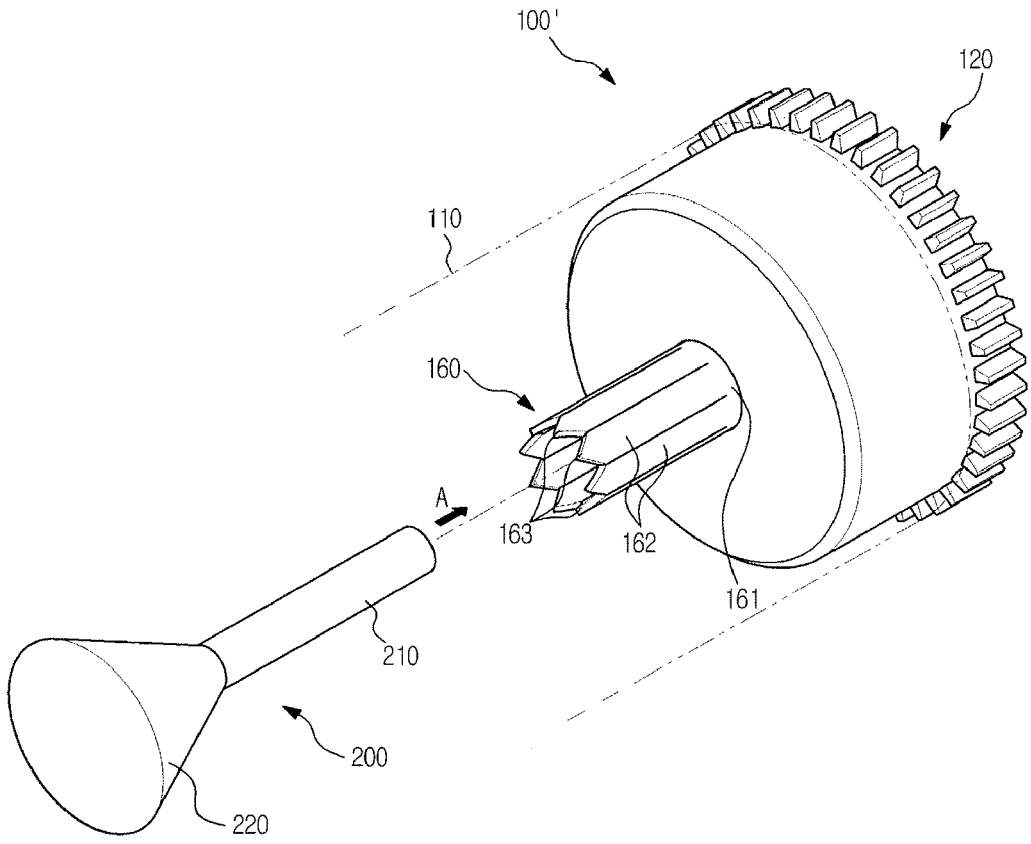
FIGS. 5 and 6 are perspective views illustrating a state of pressing a grounding device by use of an expanding tool in the photosensitive body according to the embodiment of the present general inventive concept illustrated in FIG. 2.
Figure 6:
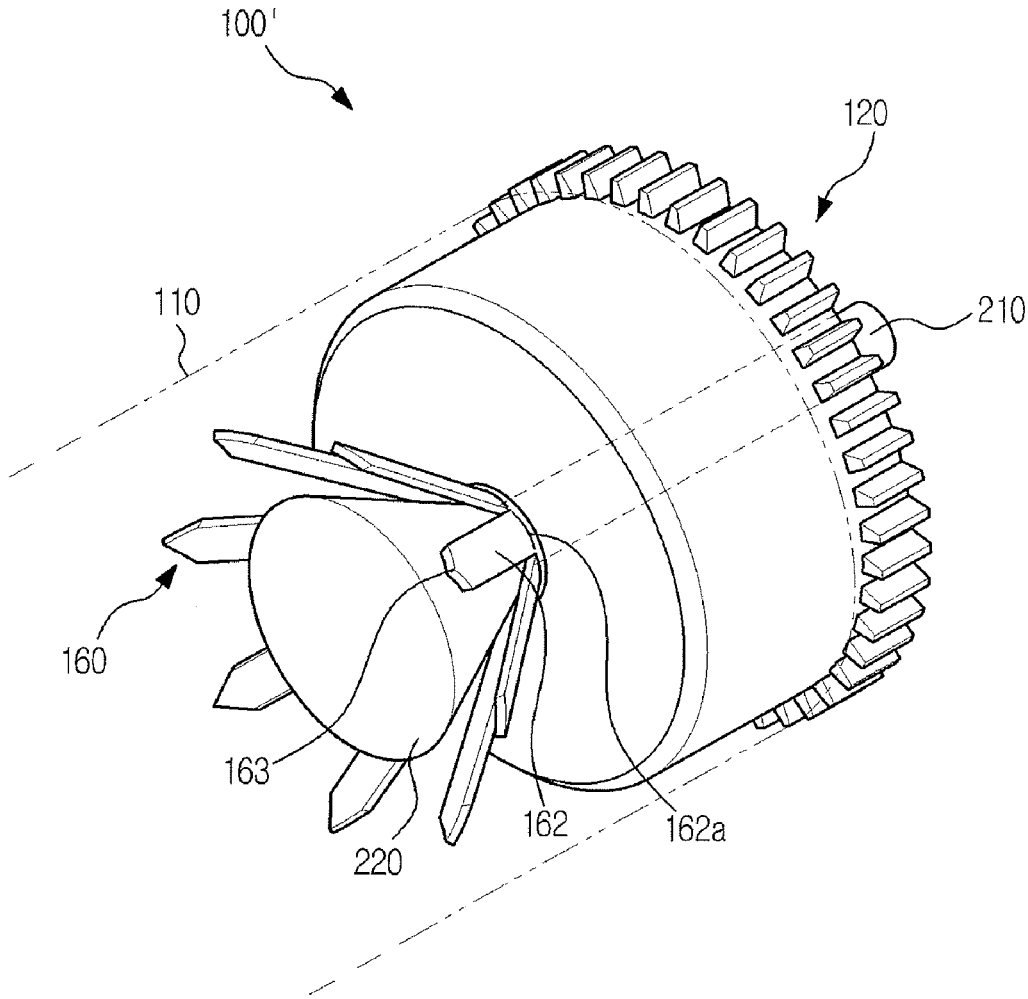

Hereinafter, a method to assemble the photosensitive body according to the embodiment illustrated in FIG. 2 will be explained with reference to FIGS. 2 to 6. FIGS. 5 and 6 are perspective views illustrating a state of pressing the grounding device by use of an expanding tool in the photosensitive body according to the embodiment illustrated in FIG. 2.

The sleeve 161 of the grounding device 160 is fixed to the flange 120 by being inserted into the shaft hole 121 of the flange 120. Then, the flange 120 is coupled to the end portion of the photosensitive drum 110, thereby forming a photosensitive drum assembly 100' (refer to FIG. 5). At this time, the shaft contacting portion 165 of the grounding device 160 is positioned inside the shaft hole 121, and the plurality of anchor portions 162 are positioned inside the photosensitive drum 110 while protruding outwardly from the flange 120. The plurality of anchor portions 162 are extended in the longitudinal direction of the photosensitive drum 110 in such an initial state that the anchor portions 162 are not fixed to the photosensitive drum 110 (refer to the imaginary line in FIG. 2).

An expanding tool 200 as illustrated in FIG. 5 is prepared. The expanding tool 200 includes a guide shaft 210 which is inserted into the plurality of anchor portions 162, and a press portion 220 which is expanded from the guide shaft 210 to have a diameter larger than the guide shaft 210.

If the guide shaft 210 of the expanding tool 200 is inserted into the plurality of anchor portions 162 and then the expanding tool 200 is pressed in the longitudinal direction (illustrated by an arrow "A" in FIG. 5) of the photosensitive drum, bending deformation occurs at junction portions 162*a* between the anchor portions 162 and the sleeve 161, and the anchor portions 162 are spread out in the radial direction of the photosensitive drum 110, as illustrated in FIG. 6. If the anchor portions 162 are further pressed from the state as illustrated in FIG. 6, the pointed portions 163 of the respective anchor portions 162 are fixedly stuck in the inner peripheral surface 112 of the photosensitive drum 110, as illustrated in FIG. 2.

After the anchor portions 162 are fixed to the photosensitive drum 110 through the above-described process, the expanding tool 200 is pulled out, and then the shaft 140 is inserted through the shaft hole 121 of the flange 120. Thereby, the photosensitive body 100 as illustrated in FIG. 2 is achieved. At this time, the shaft contacting portion 165 of the grounding device 160, which is positioned inside the shaft hole 121, is electrically connected to the shaft 140 by being contacted with the outer peripheral surface of the shaft 140.

As illustrated in FIGS. 5 and 6, the press portion 220 of the expanding tool 200 has a conic shape, however the shape of the press portion 220 is not limited to the conic shape. The press portion 220 of the expanding tool 200 may be formed in other various shapes, so long as the expanding tool 200 can expand the anchor portions 162 of the grounding device 160 in the radial direction of the photosensitive drum 110.

Figure 7:
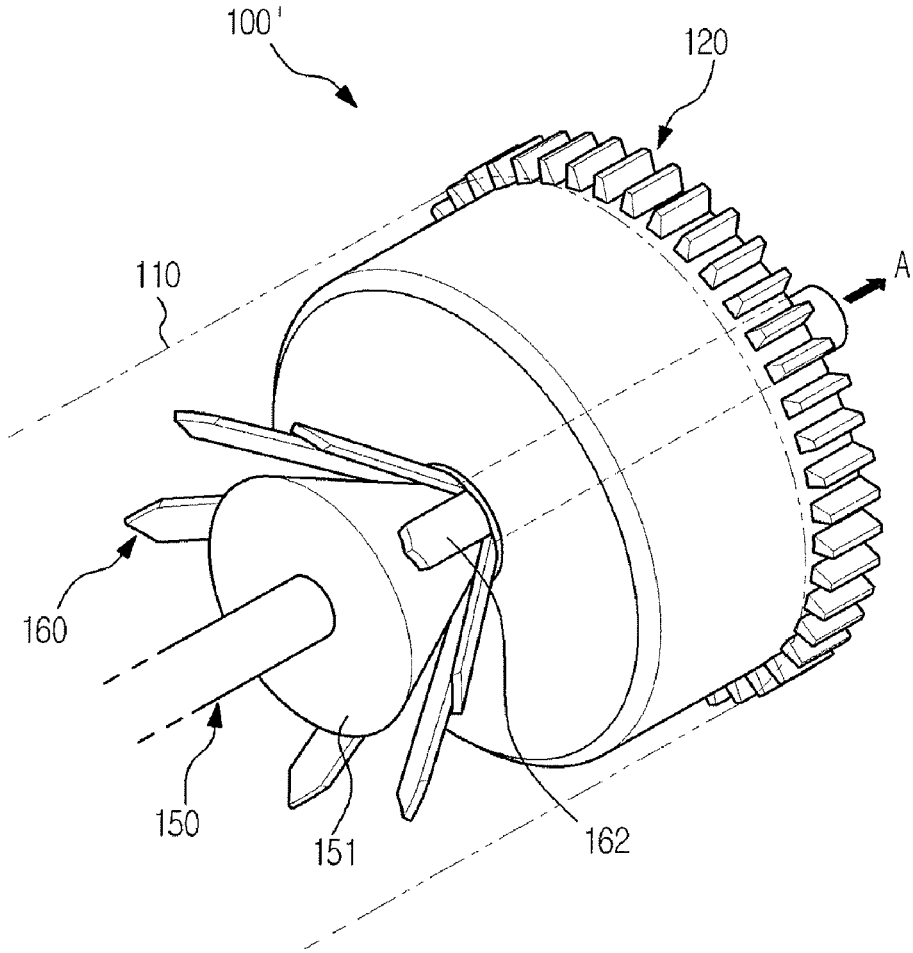
FIG. 7 is a perspective view illustrating a photosensitive body according to an embodiment of the present general inventive concept.

FIG. 7 is a perspective view illustrating a photosensitive body according to an embodiment of the present general inventive concept. This embodiment is constituted such that an expanding portion 151 is integrally formed at a shaft 150 instead of using a separate expanding tool, to expand the anchor portions 162 of the grounding device 160.

In such a case, when the photosensitive body 100 is assembled, an additional process of expanding the anchor portions 162 of the grounding device 160 is not necessary. That is, when the shaft 150 is inserted into the photosensitive drum assembly 100' in the direction of arrow "A", the anchor portions 162 are expanded in the radial direction of the photosensitive drum 110 by the expanding portion 151 formed at the shaft 150.

Figure 8:
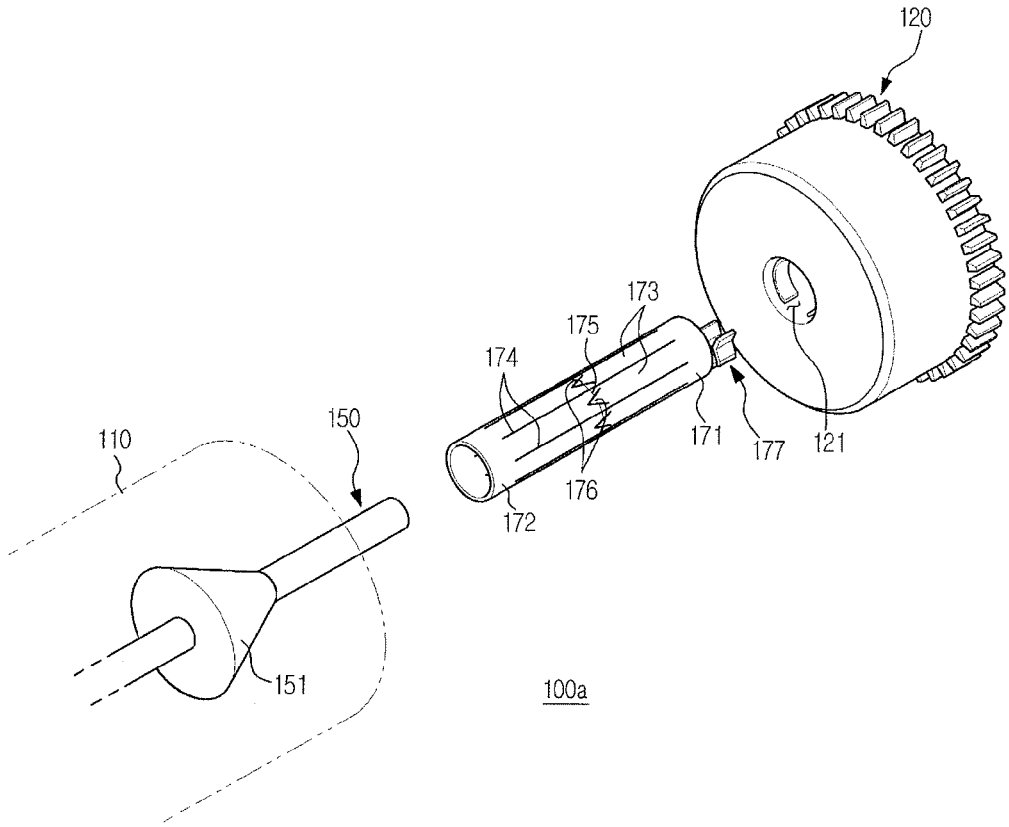
FIG. 8 is an exploded perspective view illustrating a photosensitive body according to an embodiment of the present general inventive concept.
Figure 9:
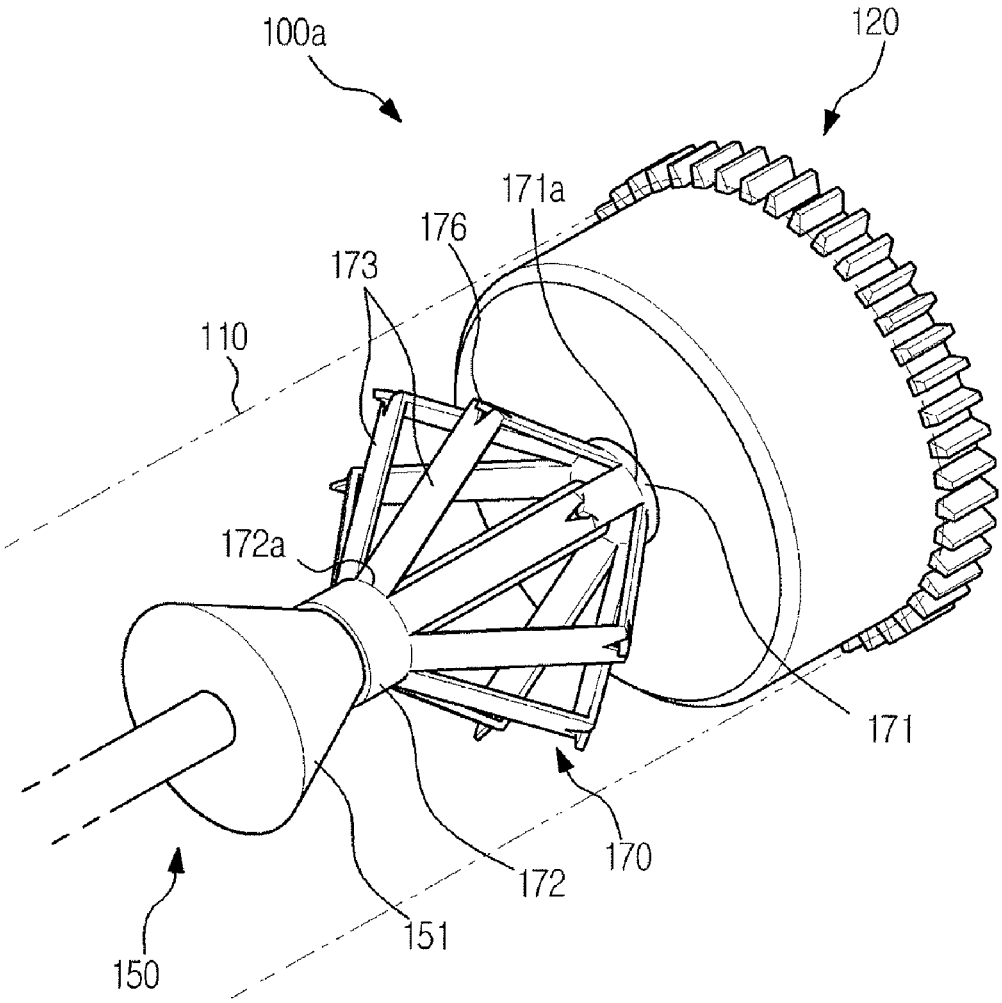
FIG. 9 is a perspective view illustrating a state of assembling a shaft in the photosensitive body depicted in FIG. 8.
Figure 10:
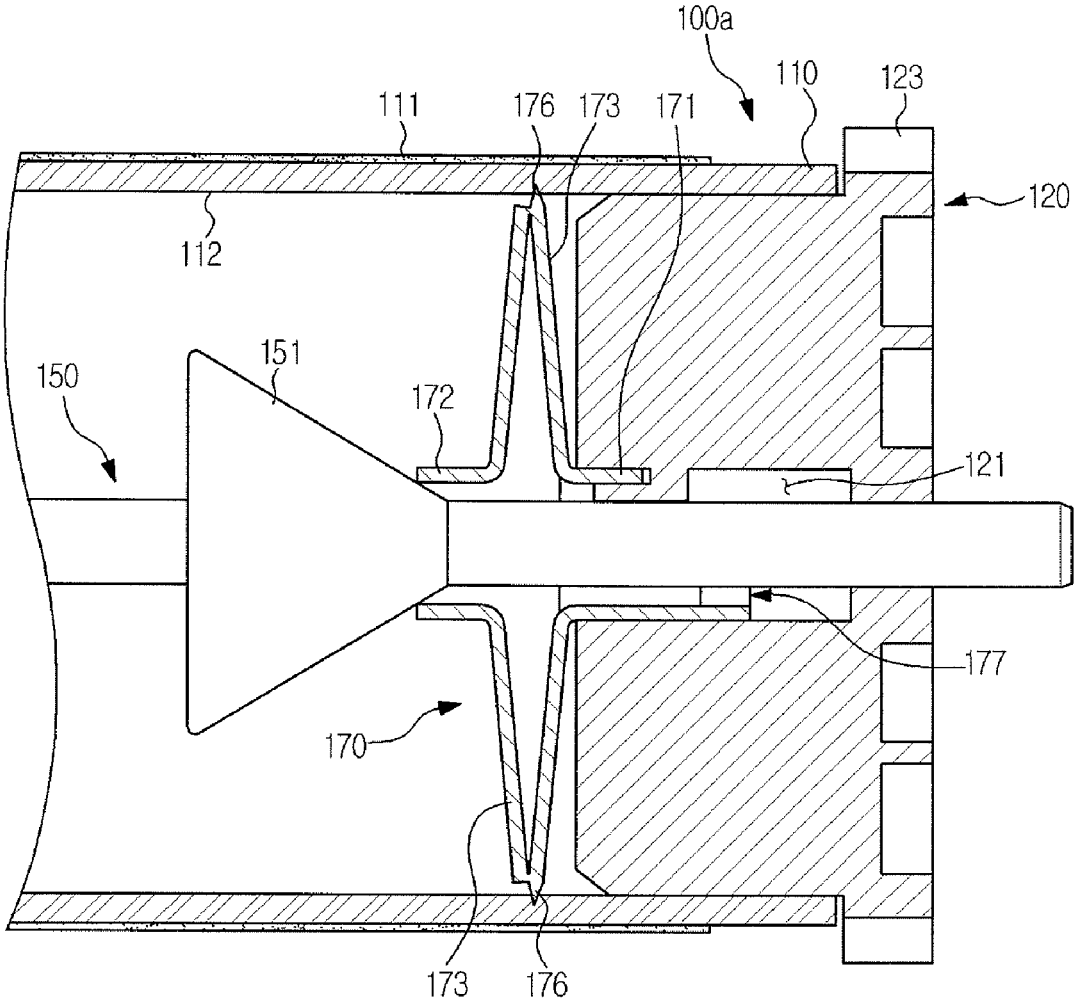
FIG. 10 is a sectional view illustrating the photosensitive body according to an embodiment of the present general inventive concept.

FIG. 8 is an exploded perspective view illustrating a photosensitive body according to an embodiment of the present general inventive concept, FIG. 9 is a perspective view illustrating a state of assembling the shaft in the photosensitive body depicted in FIG. 8, and FIG. 10 is a sectional view illustrating the photosensitive body according to the embodiment illustrated in FIG. 8. This embodiment is different from the preceding embodiments in the constitution of the grounding device. Hereinafter, only features of this embodiment over the preceding embodiments will be explained. The same components as illustrated in FIGS. 2 to 7 are denoted by the same reference numerals.

As illustrated in FIGS. 8 to 10, a grounding device 170 of a photosensitive body 100a includes a first sleeve 171 and a second sleeve 172, through which the shaft 150 passes, and a plurality of anchor portions 173 provided between the first sleeve 171 and the second sleeve 172. In an initial state as illustrated in FIG. 8, the anchor portions 173 are extended in the longitudinal direction of the photosensitive drum 110, i.e., in the axial direction of the shaft 150.

The plurality of anchor portions 173 are arranged along peripheries of the first sleeve 171 and the second sleeve 172, and are separated from each other by cutting lines 174. A first end of each of the anchor portions 173 is connected to the first sleeve 171, a second end is connected to the second sleeve 172. Each of the anchor portions 173 is formed with a bending line 175 at a middle portion thereof, at which bending deformation occurs when the grounding device 170 is pressed by the shaft 150.

Also, as illustrated in FIGS. 8 and 9, each of the anchor portions 173 has a pointed portion 176, which is formed to be cut in an arrowhead shape near the bending line 175. When the anchor portions 173 are expanded in the radial direction of the photosensitive drum 110, the pointed portions 176 are fixedly stuck in the inner peripheral surface 112 of the photosensitive drum 110.

Hereinafter, a method to assemble the photosensitive body according to the embodiment illustrated in FIG. 8 will be explained with reference to FIGS. 8 to 10.

The first sleeve 171 of the grounding device 170 is fixed to the flange 120 by being inserted into the shaft hole 121 of the flange 120. The flange 120 is coupled to the photosensitive drum 110.

As illustrated in FIG. 9, an end of the shaft 150 is inserted through the second sleeve 172, and the shaft 150 is pushed into the shaft hole 121 of the flange 120. Thereby, the expanding portion 151 of the shaft 150 interferes with the second sleeve 172 of the grounding device 170, and thus the grounding device 170 is pressed in the axial direction. Accordingly, the bending deformation occurs at the middle portions of the respective anchor portions 173, at which the bending lines 175 are formed, first junction portions 171 a between the respective anchor portions 173 and the first sleeve 171, and second junction portions 172*a* between the respective anchor portions 173 and the second sleeve 172. As a result, the respective anchor portions 173 are spread out in the radial direction of the photosensitive drum 110.

If the shaft 150 is more pushed in from the state as illustrated in FIG. 9, the respective anchor portions 173 are perfectly spread out in the radial direction of the photosensitive drum 110, and the pointed portions 176 formed at the middle portions of the respective anchor portions 173 are stuck in the inner peripheral surface of the photosensitive drum 110 as illustrated in FIG. 10. Therefore, the grounding device 170 is electrically connected to the photosensitive drum 110. Also, a shaft contacting portion 177 of the grounding device 170, which is positioned inside the shaft hole 121 of the flange 120, is contacted with the outer peripheral surface of the shaft 150. Accordingly, the grounding device 170 is electrically connected to the shaft 150.

Figure 11:
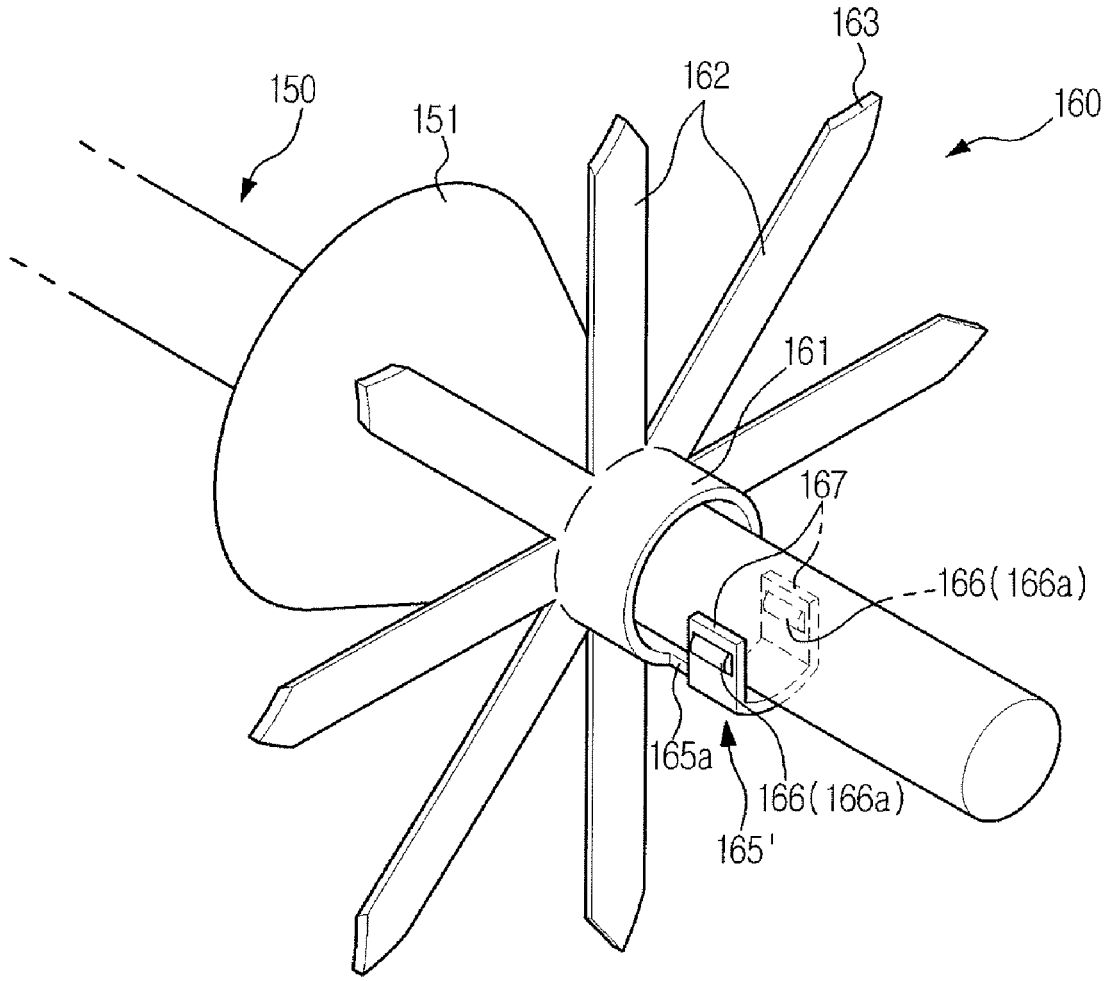
FIG. 11 is a perspective view illustrating a shaft and a grounding device in a photosensitive body according to an embodiment of the present general inventive concept.

FIG. 11 is a perspective view illustrating a shaft and a grounding device in a photosensitive body according to an embodiment of the present general inventive concept. In FIG. 11, the illustration of the photosensitive drum and the flange was omitted for convenience. The shaft in this embodiment has the expanding portion. Specifically, the photosensitive body of this embodiment includes a shaft contacting portion, which is modified from the grounding device illustrated in FIGS. 3 and 4. Hereinafter, only features of this embodiment over the preceding embodiments will be explained. The same components as illustrated in FIGS. 3 and 4 are denoted by the same reference numerals.

The grounding pieces 165*b* of the shaft contacting portion 165 as illustrated in FIG. 4 may be worn by friction with the shaft 140 when the photosensitive body 100 rotates. If the grounding pieces 165*b* are worn, the electric connection between the shaft 150 and the grounding device 160 becomes unstable. In this regard, this embodiment is constituted such that the grounding device 160 includes a shaft contacting portion 165', which is provided with conductive bearing portions 166 to support the shaft 150, as illustrated in FIG. 11.

The shaft contacting portion 165' has two supporting pieces 167, which are formed unitarily with the extending portion 165*a*. The shaft 150 is positioned between the two supporting pieces 167. The conductive bearing portions 166 are rotatably mounted to the respective supporting pieces 167. The conductive bearing portion 166 may be configured as a bearing roller 166*a*, which is made of a conductive material.

Figure 12:
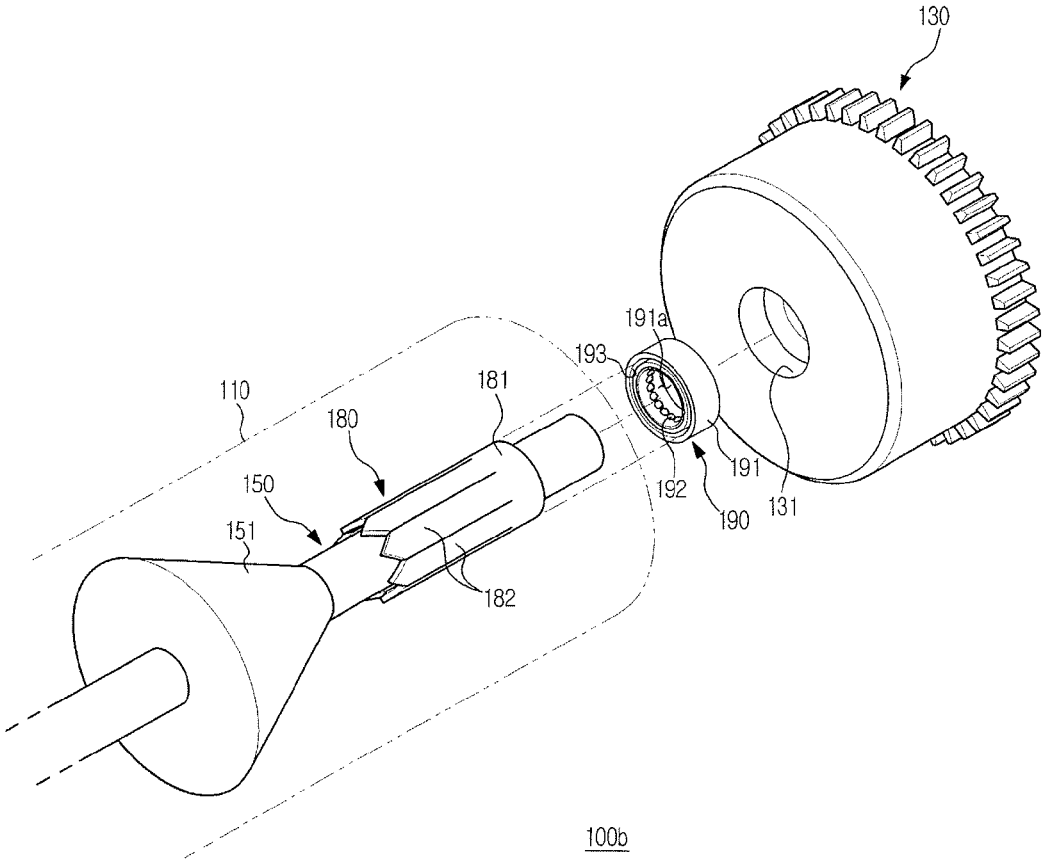
FIGS. 12 and 13 are an exploded perspective view and a sectional view, respectively, illustrating a constitution of a photosensitive body according to an embodiment of the present general inventive concept.
Figure 13:
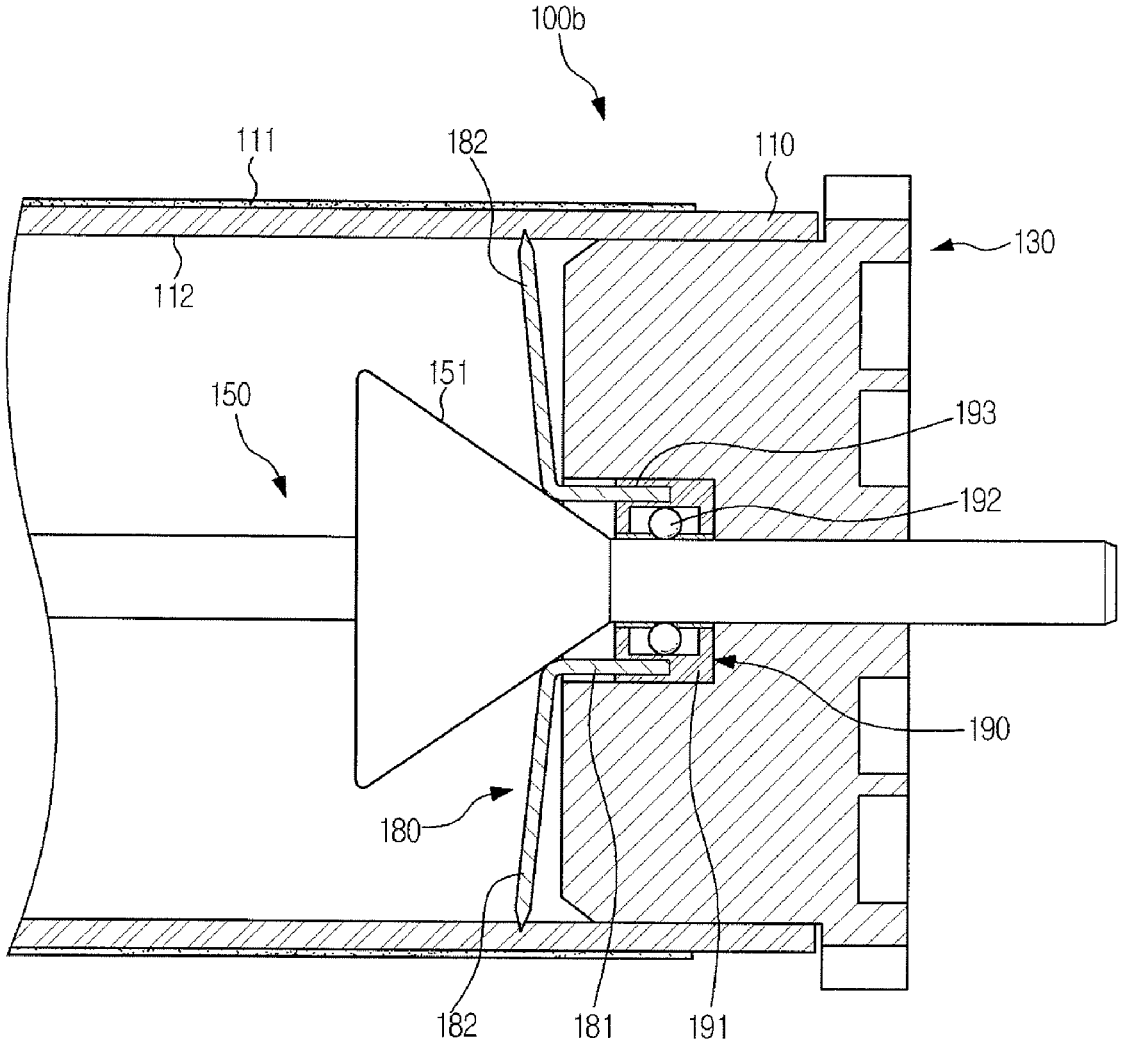

FIGS. 12 and 13 are an exploded perspective view and a sectional view, respectively, illustrating a constitution of a photosensitive body according to an embodiment of the present general inventive concept. The photosensitive body of this embodiment is constituted such that a separate bearing is mounted to the flange instead of mounting the bearing portions to the grounding device. Only features of this embodiment will be explained hereinafter.

As illustrated in FIGS. 12 and 13, a photosensitive body 100*b* of this embodiment includes a conductive bearing 190 which is mounted to a flange 130. The flange 130 is provided with a bearing receiving portion 131, in which the conductive bearing 190 is received.

The conductive bearing 190 includes a bearing housing 191 provided with a shaft hole 191*a*, through which the shaft 150 passes. A plurality of bearing balls 192 are mounted to an inner peripheral surface of the bearing housing 191, and are arranged in the peripheral direction of the bearing housing 191. A portion of each of the bearing balls 192 is exposed to the shaft hole 191*a* so as to be contacted with the shaft 150 inserted through the shaft hole 191*a*, and the remaining portion of each of the bearing balls 192 is contacted with the bearing housing 191. Both the bearing housing 191 and the bearing balls 192 are made of a conductive material.

A grounding device 180 of this embodiment includes a sleeve 181 and a plurality of anchor portions 182, similarly to the grounding device illustrated in FIG. 3. Since the method to fix the plurality of anchor portions 182 to the photosensitive drum 110 has been already explained as above, the explanation thereof will be omitted in the following description.

In this embodiment, the grounding device 180 does not include a shaft contacting portion which is directly contacted with the shaft 150. Instead, the sleeve 181 of the grounding device 180 is coupled to the conductive bearing 190, and is electrically connected with the shaft 150. To this end, the bearing housing 191 is formed with a coupling recess 193 at a front surface thereof, into which an end portion of the sleeve 181 is inserted. The sleeve 181 of the grounding device 180, which is inserted into the coupling recess 193, is electrically connected with the bearing housing 191, and the bearing housing 191 is electrically connected with the shaft 150 through the bearing balls 192 which are kept in contact with the shaft 150. Accordingly, the grounding device 180 is electrically connected with the shaft 150.

Although the above embodiments have been described with reference to the grounding device including a plurality of anchor portions, fixing the grounding device to the photosensitive drum by use of only a single anchor portion as needed is possible.

As apparent from the above description, a grounding device is securely fixed to a photosensitive drum through anchor portions which are stuck in an inner peripheral surface of the photosensitive drum. Accordingly, the electric connection between the photosensitive drum and the shaft can be prevented from becoming unstable due to non-secure contact between the grounding device and the photosensitive drum.

Further, a grounding device is prevented from being worn by providing a bearing at a contact portion with a shaft. Accordingly, an electric connection between the grounding device and the shaft can be prevented from becoming unstable, and the photosensitive body can be stably grounded even when the photosensitive body is used for a long time.

Still further, a grounding device also serves to fix a flange to a photosensitive drum in such a manner that a sleeve is fixed to the flange and anchor portions are fixed to an inner peripheral surface of the photosensitive drum. Accordingly, the flange can be securely fixed to the photosensitive drum without using a separate adhesive.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. A photosensitive body usable with an image forming apparatus, the photosensitive body comprising:

a photosensitive drum;

a shaft serving as a rotational center of the photosensitive drum; and a grounding device to electrically connect the photosensitive drum and the shaft, the grounding device including a sleeve fitted around the shaft, a shaft connecting portion electrically connected to the shaft, and an anchor portion extended from an end of the sleeve, wherein the anchor portion moves from a first state, in which the anchor portion is extended in a longitudinal direction of the photosensitive drum, to a second state, in which the anchor portion is extended in a radial direction of the photosensitive drum by a junction portion with the sleeve being bent by a force applied in an axial direction of the shaft, and is fixed to an inner peripheral surface of the photosensitive drum.

2. A photosensitive body usable with an image forming apparatus, the photosensitive body comprising:

a photosensitive drum;

a shaft serving as a rotational center of the photosensitive drum; and a grounding device to electrically connect the photosensitive drum and the shaft, the grounding device including a first sleeve and a second sleeve fitted around the shaft, a shaft connecting portion electrically connected to the shaft, and an anchor portion provided between the first sleeve and the second sleeve, wherein the anchor portion moves from a first state, in which the anchor portion is extended in a longitudinal direction of the photosensitive drum, to a second state, in which the anchor portion is extended in a radial direction of the photosensitive drum by a middle portion thereof being bent by a force applied in an axial direction of the shaft, and is fixed to an inner peripheral surface of the photosensitive drum.

3. The photosensitive body according to claim 1, wherein the shaft is provided with an expanding portion to press the anchor portion kept in the first state in an axial direction of the shaft to spread the anchor portion in the radial direction of the photosensitive drum.

4. The photosensitive body according to claim 1, wherein the anchor portion is provided with a pointed portion to be stuck in an inner peripheral surface of the photosensitive drum.

5. The photosensitive body according to claim 1, wherein the grounding device further comprises:

a conductive bearing portion to support the shaft.

6. The photosensitive body according to claim 1, further comprising:

a flange coupled to an end portion of the photosensitive drum, wherein the grounding device is fixed to the flange.

7. The photosensitive body according to claim 6, further comprising:

a conductive bearing mounted to the flange to support the shaft, wherein the grounding device is coupled to the conductive bearing.

8. An image forming apparatus, comprising:

a main body;

a shaft electrically connected to the main body;

a photosensitive drum rotating on the shaft;

a flange coupled to an end portion of the photosensitive drum; and a grounding device to electrically connect the shaft and the photosensitive drum, the grounding device including a first sleeve fitted around the shaft, and a plurality of anchor portions extending from a first end of the first sleeve in an axial direction of the shaft, wherein the plurality of anchor portions are spread out in a radial direction of the photosensitive drum by an expanding tool pressing the plurality of anchor portions in the axial direction, and are fixed to an inner peripheral surface of the photosensitive drum.

9. The image forming apparatus according to claim 8, wherein the plurality of anchor portions are provided with pointed portions to be stuck in the inner peripheral surface of the photosensitive drum.

10. The image forming apparatus according to claim 8, wherein the plurality of anchor portions are spread out in the radial direction of the photosensitive drum by junction portions with the first sleeve being bent.

11. The image forming apparatus according to claim 8, wherein the grounding device further comprises:

a second sleeve provided opposite to the first sleeve while interposing the plurality of anchor portions therebetween, and wherein the plurality of anchor portions are spread out in the radial direction of the photosensitive drum by middle portions thereof and junction portions with the first sleeve and the second sleeve being bent.

12. The image forming apparatus according to claim 8, wherein the expanding tool is integrally formed at the shaft.

13. The image forming apparatus according to claim 8, wherein the grounding device further comprises:

a shaft contacting portion connected to a second end of the first sleeve, and wherein the shaft contacting portion is elastically contacted with an outer peripheral surface of the shaft.

14. The image forming apparatus according to claim 8, wherein the grounding device further comprises:

a shaft contacting portion connected to the first sleeve, and wherein the shaft contacting portion is provided with a bearing portion to support the shaft.

15. The image forming apparatus according to claim 8, wherein the first sleeve is fixed to the flange.

16. The image forming apparatus according to claim 15, wherein the flange is provided with a conductive bearing contacted with an outer peripheral surface of the shaft, and wherein the first sleeve is fixed in contact with the bearing.

17. An assembling method of a photosensitive body, the method comprising:

fixing a grounding device having a sleeve and an anchor portion extending from an end of the sleeve in a longitudinal direction of a photosensitive drum to a flange;

coupling the flange to an end portion of the photosensitive drum to form a photosensitive drum assembly; and pressing the anchor portion in the longitudinal direction of the photosensitive drum to be spread out in a radial direction of the photosensitive drum by a junction portion with the sleeve being bent by a force applied to the anchor portion and fixed to an inner peripheral surface of the photosensitive drum.

18. The method according to claim 17, further comprising:

coupling a shaft to the photosensitive drum assembly, wherein when the shaft is coupled to the photosensitive drum assembly, the anchor portion is pressed by the shaft and is spread out in the radial direction of the photosensitive drum.

19. A photosensitive body usable with an image forming apparatus, the photosensitive body comprising:

a photosensitive drum including a shaft having an expanded portion integrally formed thereon; and a grounding device having a sleeve to receive the shaft of the photosensitive drum and one or more anchor portions extending outward from the sleeve to engage the expanded portion of the photosensitive drum, wherein the one or more anchor portions move from a first state, in which the one or more anchor portions are extended in a longitudinal direction of the photosensitive drum, to a second state, in which the one or more anchor portions are extended in a radial direction of the photosensitive drum by a junction portion with the sleeve being bent by a force applied in an axial direction of the shaft, and form an electrical connection with the photosensitive drum.

20. A photosensitive body usable with an image forming apparatus, the photosensitive body comprising:

a photosensitive drum including a shaft; and a grounding device having a plurality of sleeves to receive the shaft of the photosensitive body and a plurality of anchor portions disposed between the plurality of sleeves, wherein the anchor portions have a first end connected to one of the sleeves, a second end connected to an other of the sleeves, and a bending portion disposed between the first end and the second end to deform when the grounding device is pressed by the shaft.

* * * * *